US010442675B2

(12) United States Patent
Stuart

(10) Patent No.: US 10,442,675 B2
(45) Date of Patent: Oct. 15, 2019

(54) VENT SYSTEM FOR A FUEL STORAGE TANK

(71) Applicant: RISBRIDGER LIMITED, Redhill Surrey (GB)

(72) Inventor: Eden Graham Mansfield Stuart, Tirau (NZ)

(73) Assignee: RISBRIDGER LTD., Redhill Surrey (GB)

( * ) Notice: Subject to any disclaimer, the term of this patent is extended or adjusted under 35 U.S.C. 154(b) by 210 days.

(21) Appl. No.: 15/562,820

(22) PCT Filed: Mar. 31, 2016

(86) PCT No.: PCT/GB2016/050913
§ 371 (c)(1),
(2) Date: Sep. 28, 2017

(87) PCT Pub. No.: WO2016/156856
PCT Pub. Date: Oct. 6, 2016

(65) Prior Publication Data

US 2018/0105411 A1 Apr. 19, 2018

(30) Foreign Application Priority Data

Mar. 31, 2015 (GB) ..... 1505584.1

(51) Int. Cl.
*B67D 7/00* (2010.01)
*B67D 7/04* (2010.01)
*B67D 7/32* (2010.01)

(52) U.S. Cl.
CPC ..... *B67D 7/048* (2013.01); *B67D 7/0476* (2013.01); *B67D 7/3227* (2013.01)

(58) Field of Classification Search
CPC .... B67D 7/048; B67D 7/0488; B67D 7/3227; B67D 7/36; B67D 3/0003; B67D 7/0476; B60K 15/03519; B60K 2015/03576
See application file for complete search history.

(56) References Cited

U.S. PATENT DOCUMENTS 2,840,272 A 6/1958 Blackburn
4,260,000 A * 4/1981 McGahey ..... B67D 7/048 141/286

(Continued)

FOREIGN PATENT DOCUMENTS

WO 90 09343 A1 8/1990

*Primary Examiner* — Reinaldo Sanchez-Medina
(74) *Attorney, Agent, or Firm* — Craft Chu PLLC; Andrew W. Chu

(57) ABSTRACT

A vent system for a fuel storage tank and a pressure vacuum valve (PVV) module for use with such a vent system are disclosed. The vent system defines a vent path from the fuel storage tank to atmosphere. An elongate vent pipe extends vertically to a rain cap located at the upper end of the vent pipe. A pressure vacuum valve (PVV) is located in the vent path between the lower end of the vent pipe and the tank. The pressure vacuum valve maintains the vent path in a closed condition unless the pressure in the tank is above or below a predetermined pressure. By separating the PVV from the rain cap and placing it between the lower end of the vent pipe and the tank, it is possible to site the PVV at an accessible level for maintenance.

21 Claims, 12 Drawing Sheets

(56) References Cited

U.S. PATENT DOCUMENTS

| | | | | |
|---|---|---|---|---|
| 5,484,000 | A * | 1/1996 | Hasselmann | B67D 7/0476 141/45 |
| 5,590,697 | A * | 1/1997 | Benjey | B60K 15/03519 137/202 |
| 6,622,757 | B2 * | 9/2003 | Hart | B67D 7/0486 141/7 |
| 7,566,358 | B2 * | 7/2009 | Hart | B01D 53/0407 141/59 |
| 8,529,677 | B2 * | 9/2013 | Schroeder | B01D 53/0415 96/109 |
| 2008/0173371 | A1 | 7/2008 | Wyper | |
| 2013/0153579 | A1 | 6/2013 | Pashcow | |

* cited by examiner

VENT SYSTEM FOR A FUEL STORAGE TANK

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a vent system for fuel storage tanks such as the type employed at petrol stations.

2. Description of Related Art Including Information Disclosed Under 37 CFR 1.97 and 37 CFR 1.98

Diesel and petrol storage tanks employed at petrol stations and elsewhere are usually vented to atmosphere to avoid relative vacuum or relative pressure building up as the contents are periodically dispensed to customers' vehicles or replenished by tankers. Vapour recovery systems may be installed, in order to help reduce the volume of petroleum vapour vented to atmosphere during dispensing and/or replenishment, and this includes provision for venting of the tank at least under certain conditions, as discussed further below.

At petrol stations, for reasons of public health and safety, the vent to the atmosphere is provided at a high level. Typically, a number of vent pipes or stacks are provided, usually located away from the main customer refueling area. Diesel storage tanks are usually individually vented whereas more than one petrol storage tank may be connected to one or more vent pipe stacks via a manifold.

The vent pipes are protected at their upper end by vent caps, which serve to keep rain out of the pipes as well as birds, insects, floating debris etc. The vent caps for petrol tanks are also provided with a flame arrestor gauze, but this is not currently required for diesel tank vent caps. Flame arrestors on petrol vents can also double as screen filters for the air intake. In fact, where screen filters have been used on diesel tank vent caps, it has been found that the diesel vapour leaves a sticky residue on the filter element which can trap dirt and block. Therefore the filter would require periodic cleaning. Petrol vapour does not leave a residue, and in fact can have a self-cleaning effect.

In the case of petrol vent pipes on sites with vapour recovery systems, pressure vacuum valves are usually provided, incorporated into the vent cap. A pressure vacuum valve (PVV) is designed to keep the vent pipe closed to atmosphere unless the relative pressure or relative vacuum inside the tank exceeds pre-determined levels. The valve will then open and allow either the petroleum vapour to vent to atmosphere or atmospheric air to enter the vent pipe to control the pressure or vacuum level. In accordance with industry standards in the UK, the pressure limit is typically set to 35 millibars above atmospheric pressure and the vacuum limit is set to 2 millibars below atmospheric pressure. The main purpose of the PVV is to control vent emissions and assist vapour displaced from the tank during tanker deliveries to be pulled back into the ullage space of the tanker rather than being vented to atmosphere. Recovery of petrol vapour is an economic benefit as the vapour can be reconverted into fuel, as well as reducing emissions harmful to the environment. Diesel vapour however is not currently recovered during tanker deliveries, so PVVs are not usually employed on diesel vent pipes. If they were, they would suffer from similar diesel vapour residue issues as described above in relation to filter elements.

It will be necessary periodically to check and service the vent caps and PVVs. However, vent pipes are usually about 6 meters in height. Regulations governing working at height prevent the use of ladders and therefore Petrol Station Operators or Contractors are required to use mobile access platforms ("cherry pickers") or other approved means of accessing the tops of the vent pipes. This procedure is relatively time-consuming and expensive, and also takes up space on site which adds to operational difficulties.

BRIEF SUMMARY OF THE INVENTION

In accordance with the invention, there is provided a vent system for a fuel storage tank, the vent system defining a vent path from the fuel storage tank to atmosphere and comprising an elongate vent pipe which extends vertically to a rain cap located at the upper end of the vent pipe, and a pressure vacuum valve (PVV) located in the vent path between the lower end of the vent pipe and the tank, or at some other easily accessible point, wherein the pressure vacuum valve maintains the vent path in a closed condition unless the pressure in the tank is above or below a predetermined pressure.

By separating the PVV from the rain cap and placing it between the lower end of the vent pipe and the tank, it is possible to site the PVV at an accessible level for maintenance, without the need for a mobile access platform or a hinged joint in the vent pipe. Only the rain cap, which is a low-maintenance component, needs to be retained at a high level.

Preferably therefore, the PVV is accessible from the ground. In more preferred embodiments, the PVV is located in the vent path at a height no greater than 1.8 meters, 1.5 meters or 1 meter above ground. In most applications, the fuel storage tank is located underground.

In order to facilitate maintenance of the PVV, as well as removal if necessary, the vent path preferably deviates from the axis of the vent pipe to the pressure vacuum valve which is located in a position offset from the vent pipe axis. As will be seen from the preferred embodiments described below, this arrangement provides easier access to the PVV.

Preferably, the PVV is located in a PVV module, the vent path passing through the PVV module via the PVV. Preferably, the pressure vacuum valve is removable from the pressure vacuum valve module. This allows the PVV to be replaced if necessary, rather than cleaned and repaired on-site, to reduce down-time at the filling station. The PVV can then be taken off-site for maintenance. The invention extends to a pressure vacuum valve module for use with the vent system as described herein.

The pressure vacuum valve is preferably secured in the pressure vacuum valve module with tamper-proof fixings for additional security, to prevent tampering or theft and potential access to the tank contents.

In preferred embodiments, the pressure vacuum valve module includes a shut-off valve which closes the vent path when the pressure vacuum valve is removed from the pressure vacuum valve module. Preferably, the pressure vacuum valve holds the shut-off valve in the open position when located in the pressure vacuum valve module, against a biasing force, so that the shut-off valve closes the vent path automatically when the pressure vacuum valve is removed from the pressure vacuum valve module. The auto shut-off valve reduces the risk of vapour loss and contamination while the PVV is removed.

The PVV preferably includes a pressure relief valve which opens the vent path when the pressure in the tank is higher than a predetermined value, allowing the excess pressure in the tank to be relieved through the vent path.

Alternatively or in addition to the pressure relief valve, the PVV preferably includes a vacuum relief valve which opens when the pressure in the tank is lower than a predetermined value. In one preferred embodiment, the vacuum relief valve opens the vent path when the pressure in the tank is lower than a predetermined value, allowing the excess vacuum in the tank to be relieved through the vent path. In an alternative embodiment, the pressure vacuum valve includes an inlet in connection with the vacuum relief valve and the vacuum relief valve opens the inlet when the pressure in the tank is lower than a predetermined value, allowing the excess vacuum in the tank to be relieved through the inlet and not through the vent path. The inlet may be located at a relatively low, accessible level and is preferably part of the removable PVV assembly. The inlet may be provided with a filter and may be connected to a source of substantially dry and/or inert gas. Using a dry source of gas/air (e.g. from an air conditioning unit) further helps to reduce water contamination from moist air.

In a diesel application, having a separate low level source of inlet air/gas, optionally filtered and dried, while maintaining venting through the vent path, provides the advantage that diesel vapour does not pass out through the intake filter or vacuum relief valve, and therefore they can remain free of sticky residue from the diesel vapour.

In this embodiment, since venting out is still via the rain cap at high-level and it is only the inlet which is located at low-level, low-level vapour release is prevented.

Preferably, the predetermined pressure value at which the pressure relief valve opens is different from the predetermined pressure value at which the vacuum relief valve opens. As discussed in the introduction, the former may be about 35 millibars above atmospheric pressure and the latter about 2 millibars below atmospheric pressure, but this can vary according to local regulations.

As mentioned above, the invention includes a rain cap located at the upper end of the vent pipe. Preferably the vent path through the rain cap is serpentine in order to trap any moisture and reduce fuel contamination. Preferably, a drainage aperture is provided in the serpentine path at the lowermost point of the path, which will allow any trapped moisture to drip out.

In a particularly preferred embodiment, the vent pipe includes a condensate collector to collect water condensing on the inside of vent pipe. Preferably, the condensate collector comprises an annular condensate collection cavity formed between the inner wall of the vent pipe and the outer wall of a pipe of a smaller diameter mounted coaxially within the vent pipe. In a preferred embodiment, the condensate collector further comprises a discharge valve which opens to discharge the condensate when the condensate has reached a predetermined level in the collection cavity. The condensate collector, including its preferred and optional features, helps to further reduce water contamination of the fuel system.

One or more test apertures are preferably provided in the vent path. In a preferred embodiment, a test aperture or port is provided either side of the pressure vacuum valve. The test ports allow for monitoring of system pressures, testing the PVV and checking for rain cap blockage.

Preferably the test ports are provided in the PVV module, for low-level access.

The present invention, including its optional and preferred features, provides an improved vent system for a fuel storage tank. The invention permits the location of the PVV module and PVV at an accessible, low level so that maintenance and/or replacement is faster and more convenient than prior art systems. The amount of filling station down-time is greatly reduced, and there is no need to cordon off an area of the site as is necessary when accessing traditional high-level PVVs.

BRIEF DESCRIPTION OF THE SEVERAL VIEWS OF THE DRAWINGS

Embodiments of the invention will now be described by way of example only and with reference to the accompanying drawings.

DETAILED DESCRIPTION OF THE INVENTION

Petrol Embodiment

Figure 1:
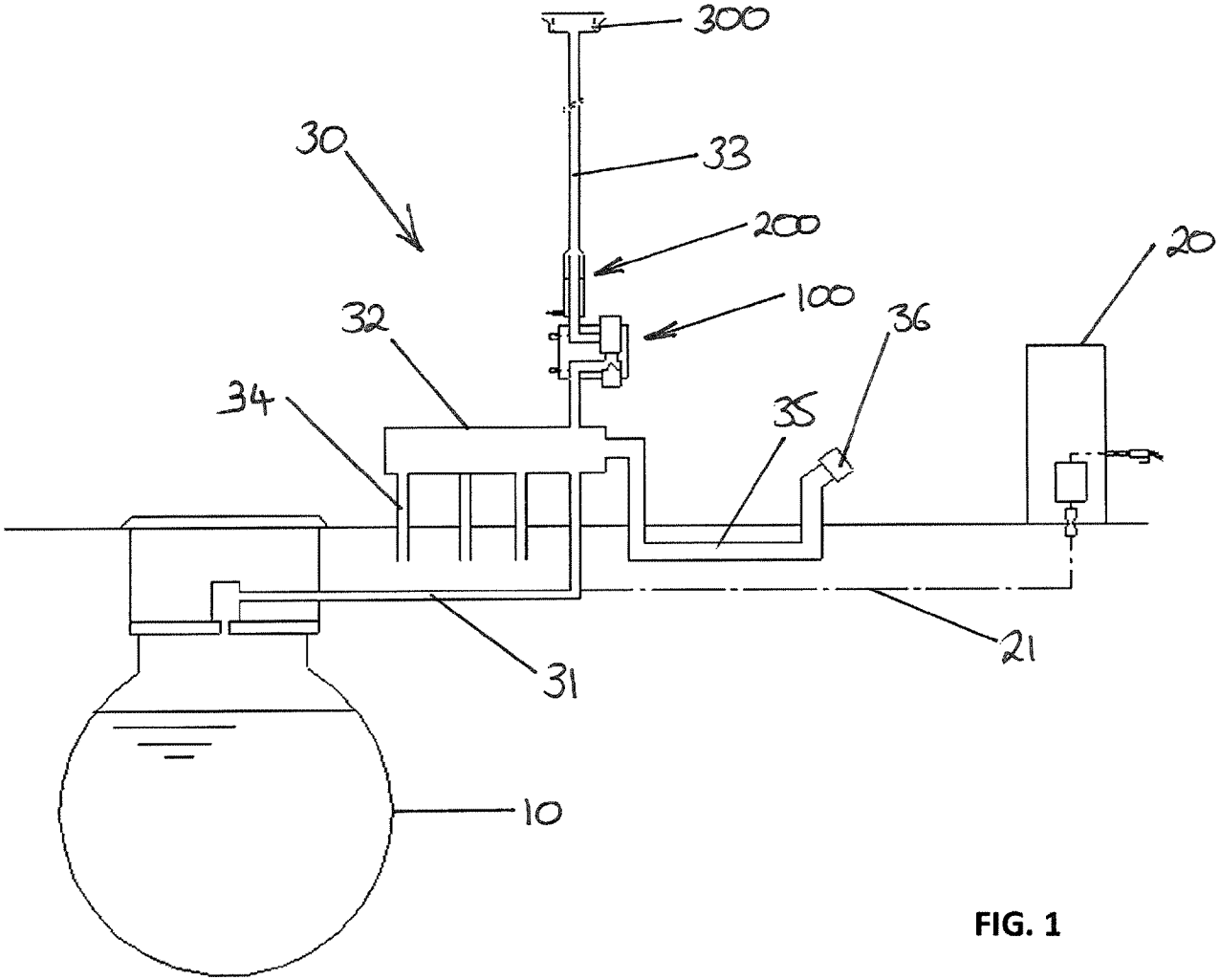
FIG. 1 shows a general schematic view of a diagram of a typical filling station installation, showing an underground petrol storage tank and a vent path having a pressure vacuum valve module in accordance with a first embodiment of the invention, suitable for petrol applications.

With reference to FIG. 1, a general schematic diagram of a typical filling station petrol installation is shown. Only the vent/vapour lines are shown; the petrol delivery lines are omitted for clarity. The installation comprises an underground petrol storage tank 10, a petrol pump 20 (also known as a stage 2 petrol dispenser) and a vent path from the underground storage tank to atmosphere shown generally as 30. A vapour line 21 is shown extending between petrol pump 20 and vent path 30, for stage 2 vapour recovery during vehicle refueling.

Vent path 30 comprises a vapour line 31 from the storage tank 10 to a low-level petrol vapour manifold 32, a pressure vacuum valve (PVV) module 100, a condensate collector 200, and an elongate vent pipe 33 extending vertically to rain cap 300. Multiple vapour lines 34 from other petrol storage tanks may feed into manifold 32. A vapour recovery pipe 35 leads from manifold 32 to a vapour recovery connection 36, which is employed when the underground tank 10 is being refilled by tanker, known as stage Ib vapour recovery.

Figure 2:
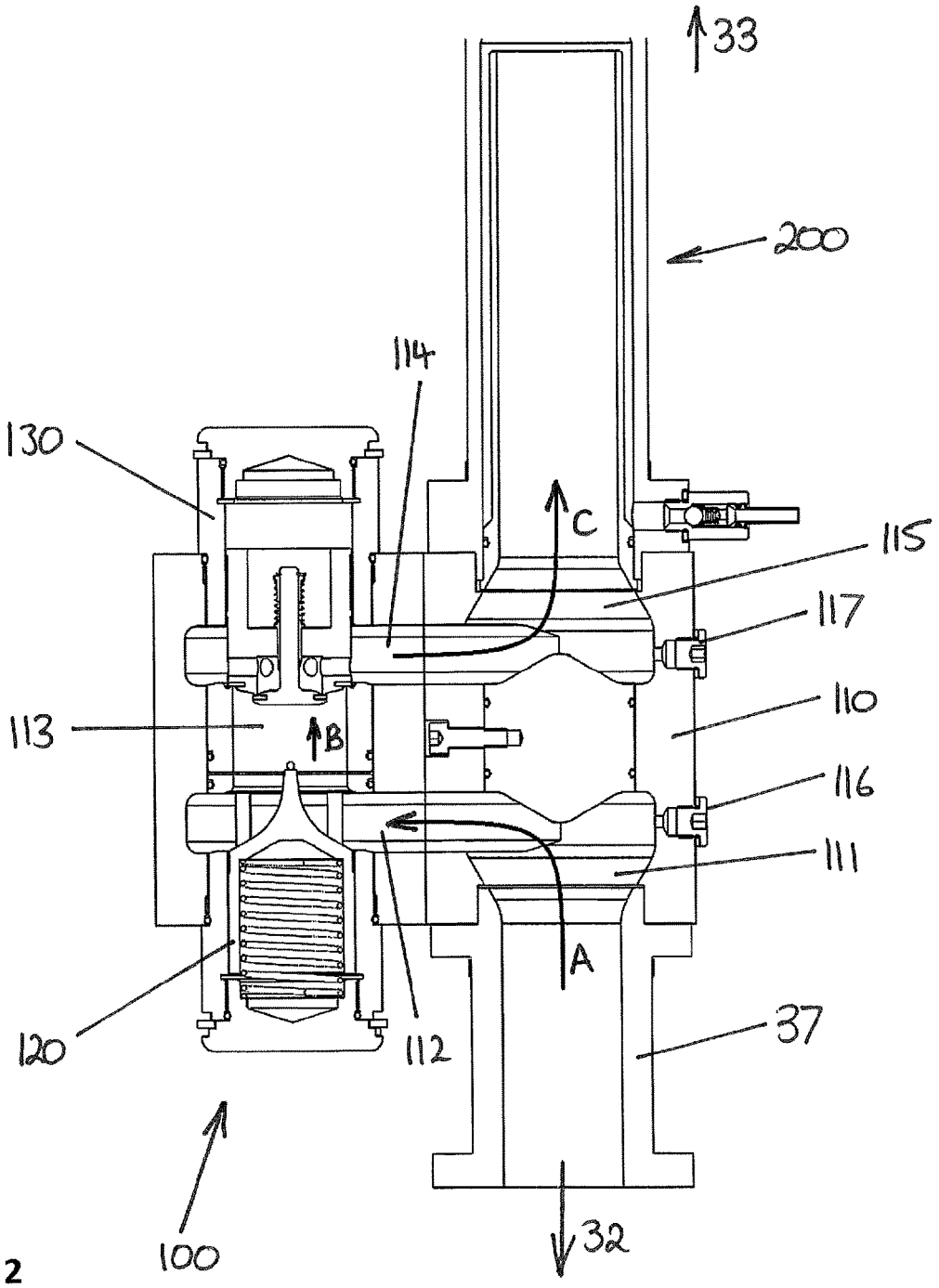
FIG. 2 shows a cross-sectional side view of the pressure vacuum valve module of FIG. 1, in which the pressure vacuum valve is in a closed condition.

The pressure vacuum valve module 100 shown in FIG. 1 is in accordance with a first embodiment of the invention, and is shown in more detail in FIG. 2. The module comprises a module body 110, a shut-off valve 120 and a pressure vacuum valve (PVV) 130. Module body 110 has a lower port 111. A length of pipe 37 connects the vent path between the manifold 32 and the lower port 111.

In FIG. 2, arrow A shows the vent path from pipe 37, through lower port 111, via duct 112 and up to shut-off valve 120. Arrow B shows the vent path from shut-off valve 120 to PVV 130 via chamber 113. Arrow C shows the vent path from PVV 130 to condensate collector 200 via duct 114 and upper port 115. Condensate collector 200 is connected to the upper port 115, and connects the vent path between the module body 110 and the vent pipe 33. As can be seen, the vent path through the pressure vacuum valve module 100 deviates from the main axis of the vent stack pipe 33 in order to pass via the shut-off valve 120 and PVV 130.

Test ports 116 and 117 are provided in ducts 112 and 114 respectively which allow test equipment to be connected to the module, so that pressure and safety testing can be carried out.

In FIG. 2, it can be seen that PVV 130 is exposed to the storage tank side of the vent path on one side and to atmosphere on the other side. In the figure shown, PVV 130 is closed and therefore the vent path is not open to the atmosphere. Clearly, the relative pressure or relative vacuum at which the PVV 130 opens can be set to any appropriate values as required in the specific application. In this preferred embodiment, which is the petrol storage tank application, the PVV 130 is configured to open if the pressure P in the storage tank is more than 2 millibars below atmospheric pressure (i.e. 2 millibars of relative vacuum) or is more than 35 millibars above atmospheric pressure (i.e. 35 millibars of relative pressure).

Figure 3:
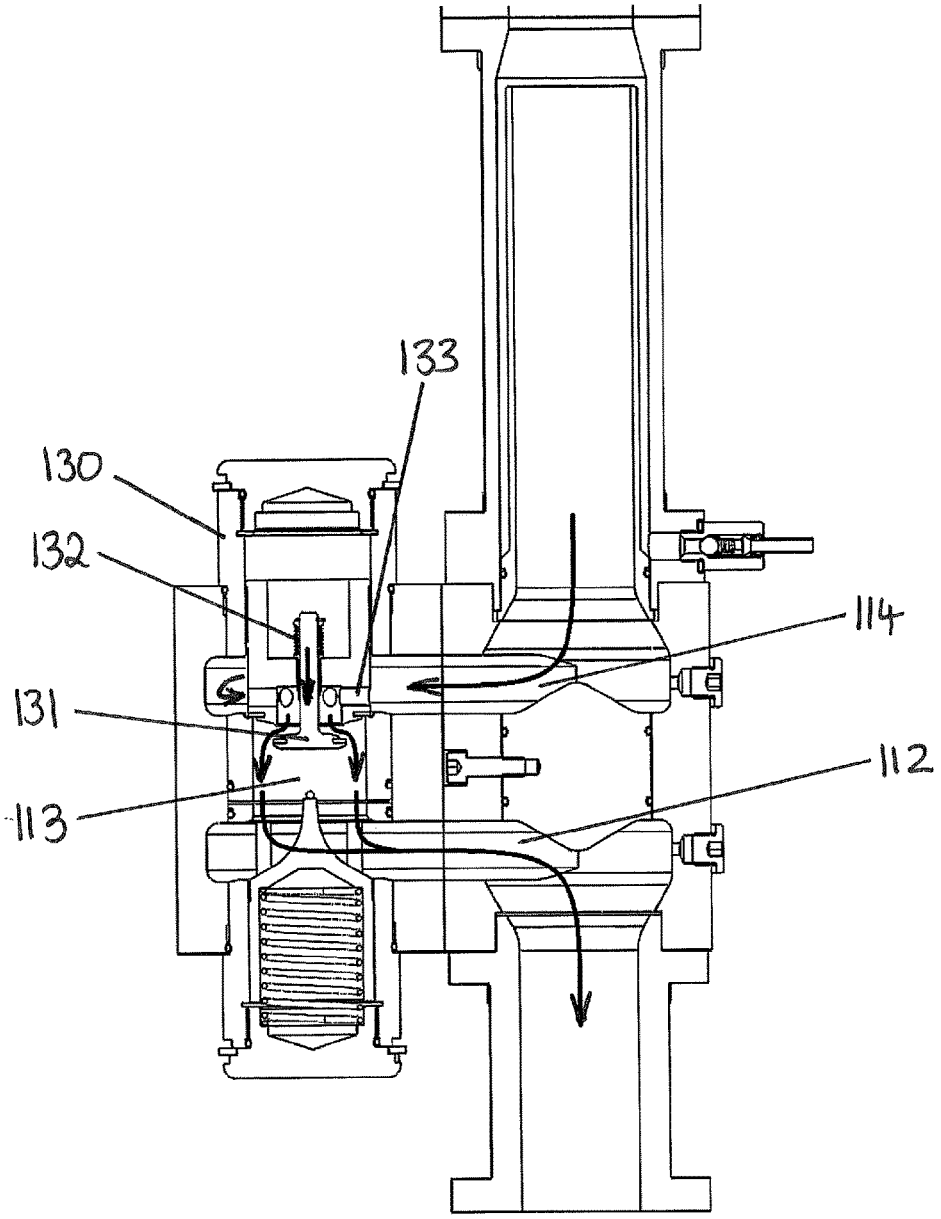
FIG. 3 shows a cross-sectional side view of the pressure vacuum valve module of FIG. 1, in which the pressure vacuum valve is under excess vacuum conditions.

FIG. 3 shows the PVV 130 under excess vacuum conditions, in which the relative vacuum in the storage tank 10 is initially greater than the maximum allowed value, i.e. greater than 2 millibars below atmospheric pressure. Vacuum valve 131 is drawn down in the direction of the arrow to its open position by the vacuum against the biasing force provided by spring 132. This permits duct 114 to connect with chamber 113 via passages 133. The arrows show the flow of atmospheric air/vapour from the vent pipe 33 to manifold 32, which relieves the excess vacuum in storage tank 10. Once the excess vacuum has been relieved, vacuum valve 131 will be drawn up to its closed position under the action of biasing spring 132.

Figure 4:
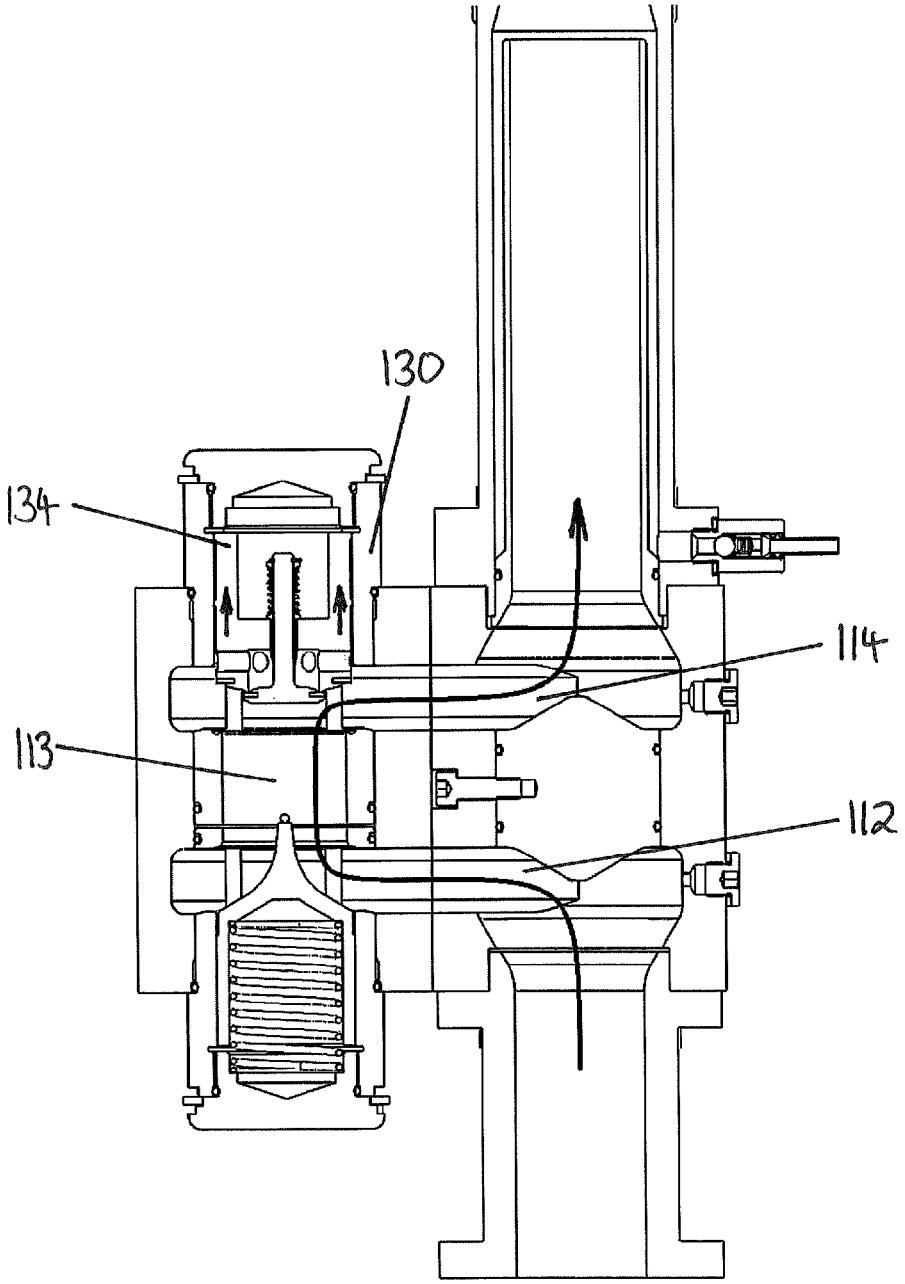
FIG. 4 shows a cross-sectional side view of the pressure vacuum valve module of FIG. 1, in which the pressure vacuum valve is under excess pressure conditions.

FIG. 4 shows the PVV 130 under excess pressure conditions, in which the relative pressure in the storage tank 10 is initially greater than the maximum allowed value, e.g. greater than 35 millibars above atmospheric pressure.

Figure 5:
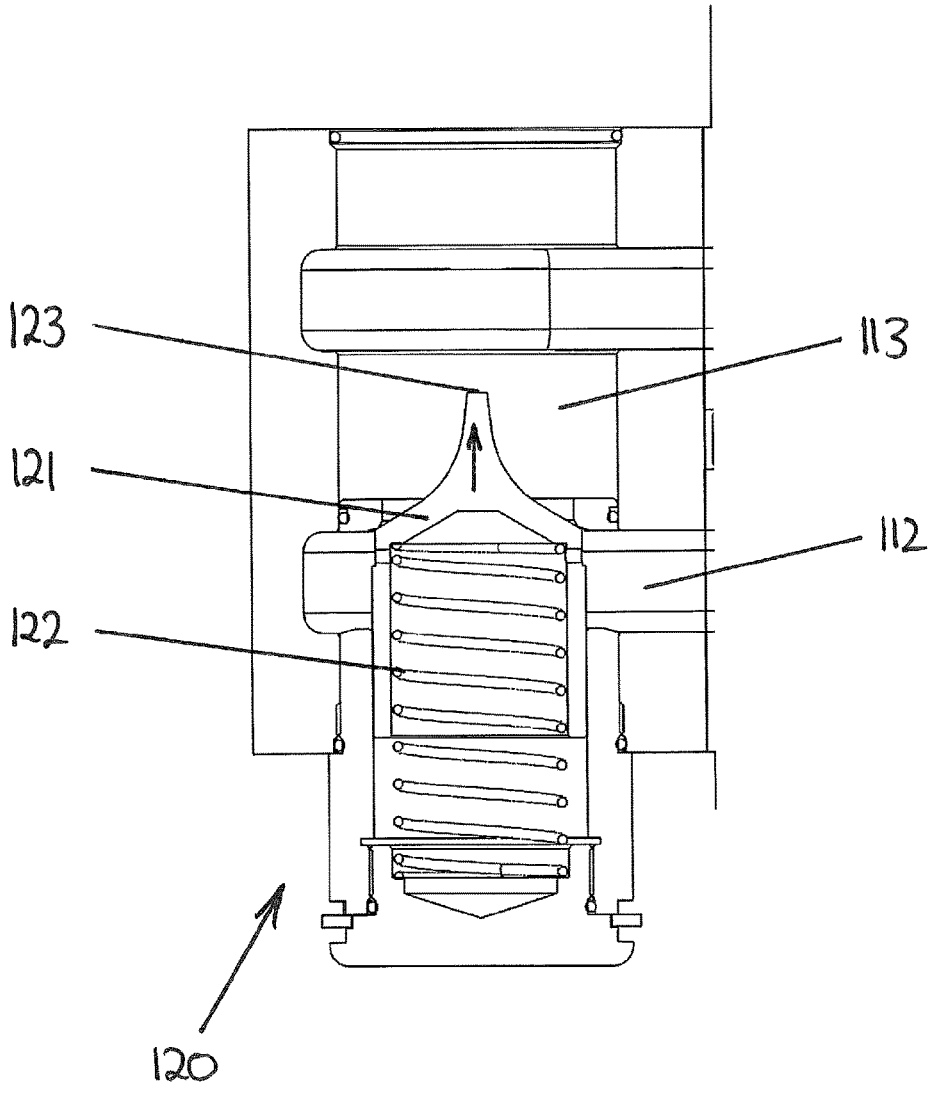
FIG. 5 shows a detailed cross-sectional view of the pressure vacuum valve module of FIG. 1, in which the pressure vacuum valve has been removed.

The pressure-relief function of the PVV 130 is performed by piston 134, which supports vacuum valve 131 within it. Piston 134 is pushed up in the direction of the arrows to its open position by the relative pressure in the storage tank 10, against the biasing force provided by the weight of the piston. As the piston 134 rises, chamber 113 is connected to duct 114. The arrows show the flow of vapour from the manifold 32 to the vent pipe 33, which relieves the excess pressure in storage tank 10. Once the excess pressure has been relieved, piston 134 returns to its closed position In FIG. 5, the PVV 130 has been removed from PVV module body 110, which causes shut-off valve 120 to automatically close off duct 112 from chamber 113 by means of the piston 121 rising up under a biasing force provided by spring 122 to block duct 112. When the PVV 130 is inserted in the PVV module body 110 (as shown in FIGS. 2-4), the PVV acts against the tip 123 of piston 121, forcing and holding it down so that duct 112 is in connection with chamber 113.

Figure 6:
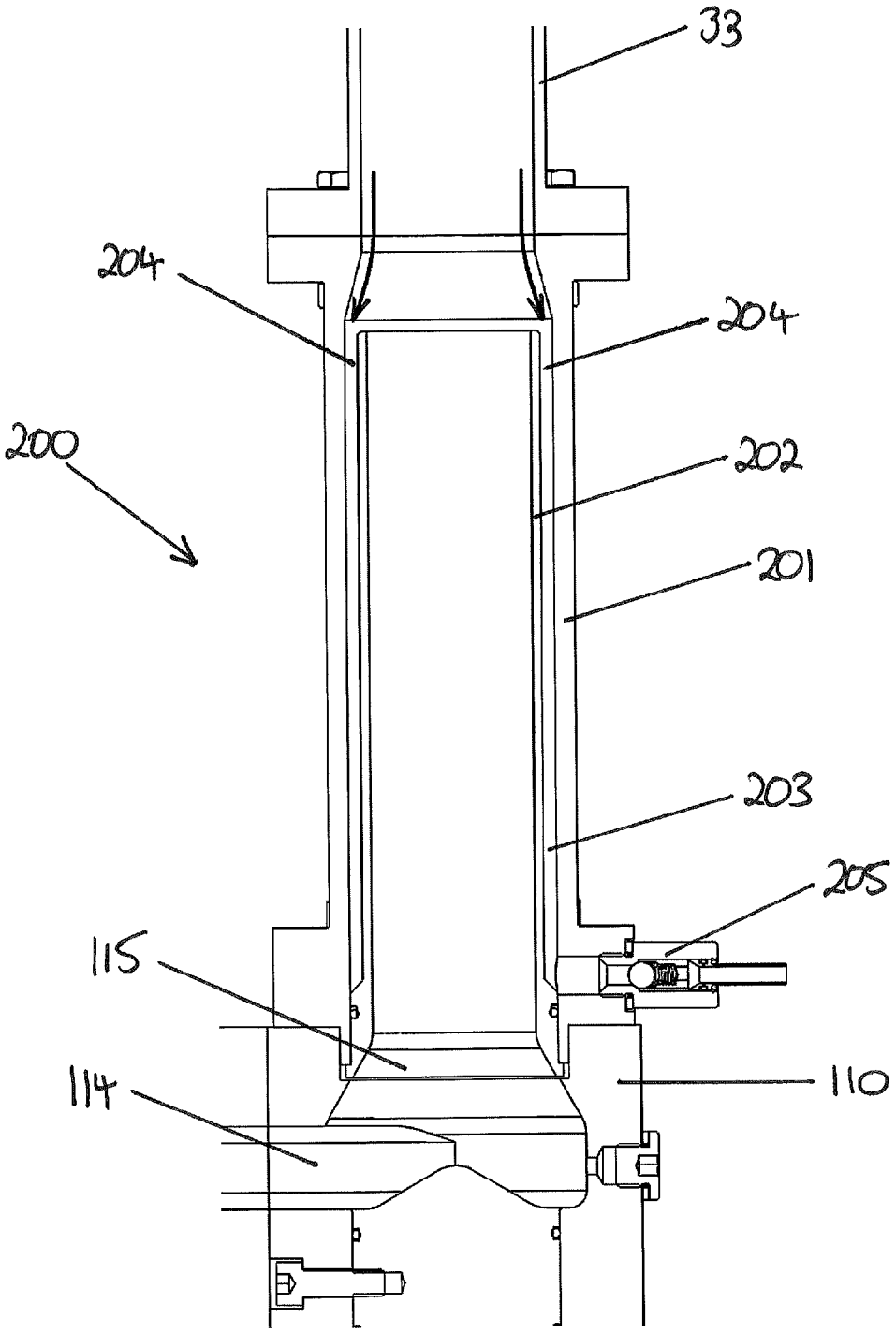
FIG. 6 shows a detailed cross-sectional view of a condensate collector, suitable for use with either embodiment of the invention.

FIG. 6 shows a detailed cross-sectional view of a condensate collector 200, suitable for use with either the petrol embodiment of the invention discussed above or the diesel embodiment of the invention discussed further below. Condensate collector 200 is connected to the upper port 115 of PVV module body 110, and connects the vent path between the module body 110 and the vent pipe 33.

Condensate collector 200 comprises an outer pipe 201 connecting between the module body 110 and the vent pipe 33 and an inner pipe section 202 of smaller external diameter than the internal diameter of pipe 201 but mounted coaxially with it, so that an annular collection cavity 203 closed at its lower end is formed between the two pipes. Inner pipe section 202 stops short of the upper end of external pipe 201, and an opening 204 is provided at the upper end of the annular collection cavity 203. Condensation forming on the inside surface of vent pipe 33 will therefore run down the inside surface of pipe 201 and will automatically pass through opening 204 and collect in collection cavity 203, as shown by the arrows. The internal diameter of outer pipe 201 is made larger than that of vent pipe 33, in order to accommodate inner pipe 202 without reducing the cross-sectional area of the vent path.

A discharge relief check valve 205 automatically opens to empty the collection cavity 203 when the head reaches 150 mm of water or 15 millibars. This setting prevents low-level vapour discharge through check valve 205 should a slight positive back-pressure be created in this part of the vent path when the vent path is operating at its maximum rated flow rate.

Figure 7:
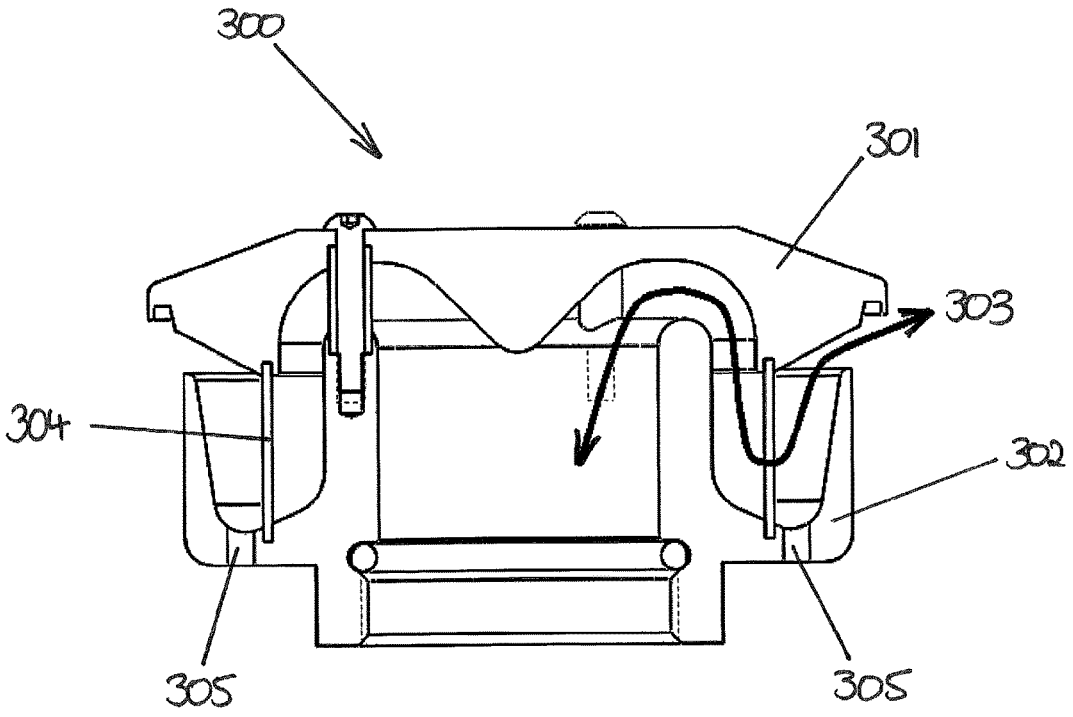
FIG. 7 shows a cross-sectional view of a rain cap suitable for petrol applications.

FIG. 7 shows a cross-sectional view of a rain cap 300 suitable for petrol applications. Rain cap 300 is mounted at the upper end of vent pipe 33 and is formed from upper body 301 and lower body 302. When the upper and lower bodies are fitted together, a serpentine vent path 303 through the rain cap is formed. In this petrol embodiment, flame arrester gauze 304 is also fitted.

Drainage holes 305 are provided at appropriate intervals through lower body 302.

Diesel Embodiment

Figure 8:
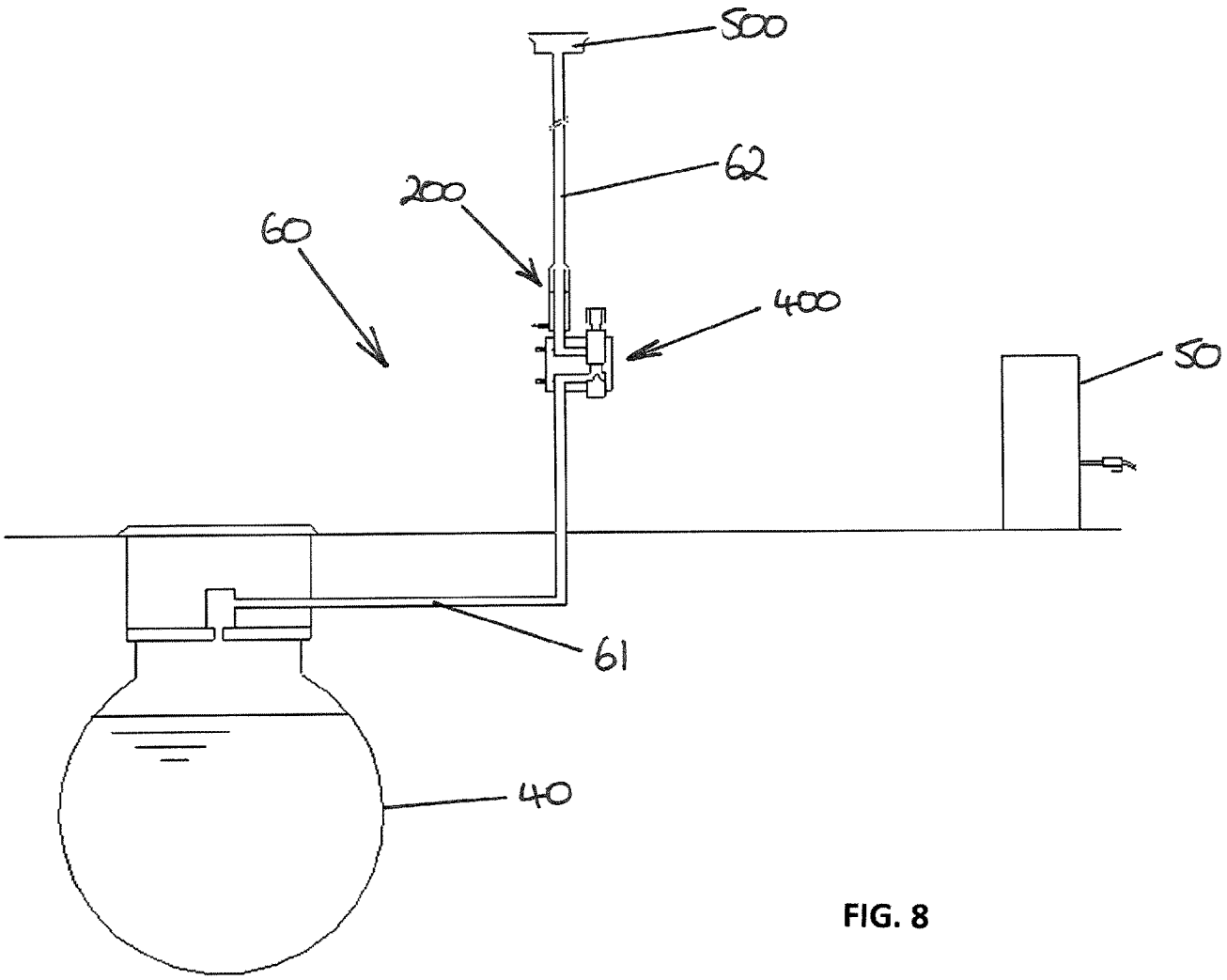
FIG. 8 shows a general schematic view of a diagram of a typical filling station installation, showing an underground diesel storage tank and a vent path having a pressure vacuum valve module in accordance with a second embodiment of the invention, suitable for diesel applications.

With reference to FIG. 8, a general schematic diagram of a typical filling station diesel installation is shown. Only the vent/vapour lines are shown; the diesel delivery lines are omitted for clarity. In diesel applications, vapour recovery during vehicle re-fuelling and during tanker refilling is not typically carried out and therefore vapour recovery lines are not shown.

The installation comprises an underground diesel storage tank 40, a diesel pump 50 and a vent path from the underground storage tank to atmosphere shown generally as 60. Vent path 60 comprises a vapour line 61 from the storage tank 40 to the pressure vacuum valve (PVV) module 400, condensate collector 200, and an elongate vent pipe 62 extending vertically to rain cap 500.

Figure 9:
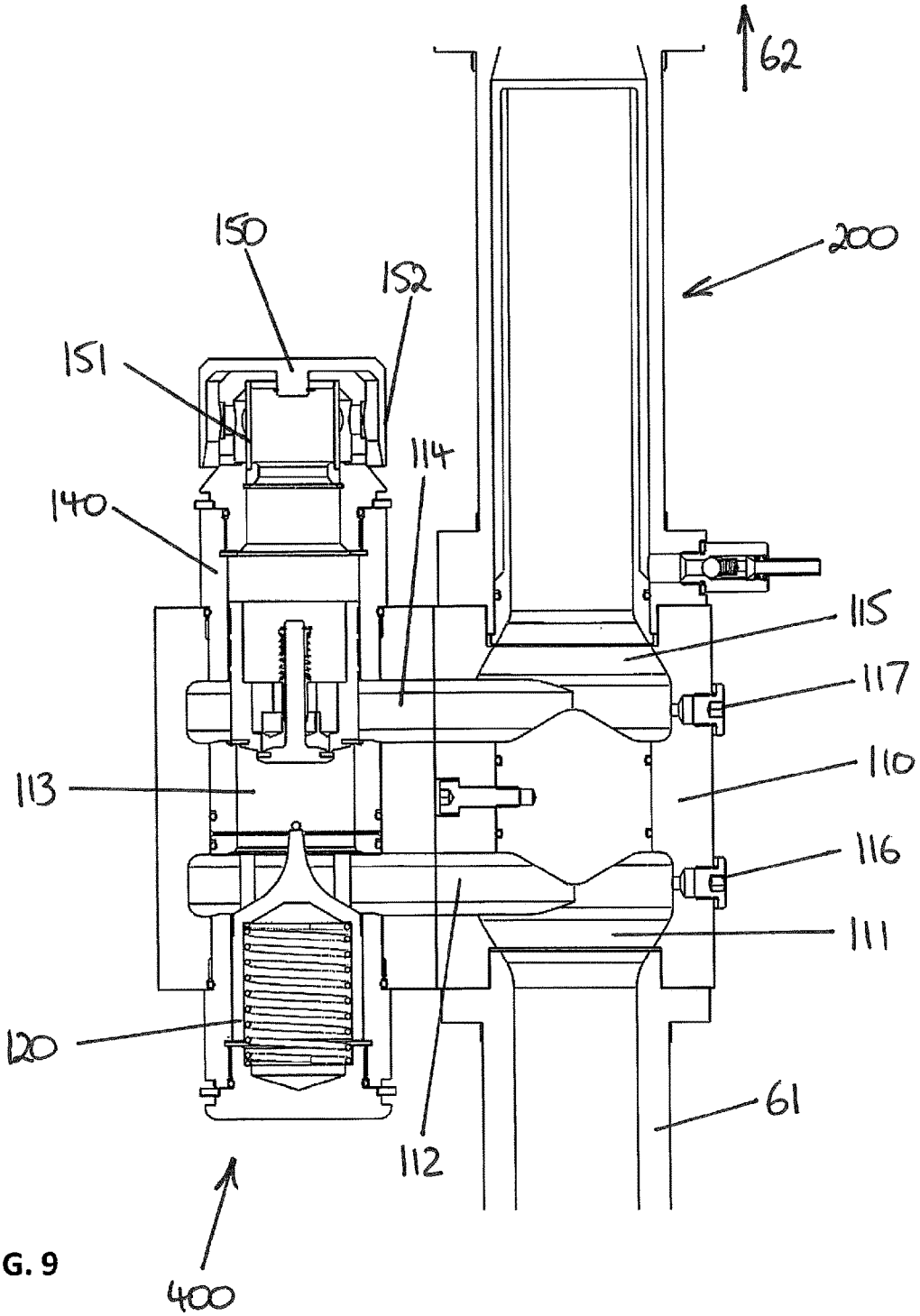
FIG. 9 shows a cross-sectional side view of the pressure vacuum valve module of FIG. 8, in which the pressure vacuum valve is in a closed condition.

The pressure vacuum valve module 400 shown in FIG. 8 is in accordance with a second embodiment of the invention, and is shown in more detail in FIG. 9. Where components are identical to the first embodiment of the pressure vacuum valve module 100 shown in FIGS. 2-5, the same reference numbers have been employed.

The module 400 comprises a module body 110, a shut-off valve 120 and a pressure vacuum valve (PVV) 140. The principle of operation of PVV module 400 is the same as module 100 (FIG. 1). The difference in this embodiment is that PVV 140 is fitted with a low-level air intake 150. When under excess vacuum conditions, air is drawn in through air intake 150 rather than through the vent pipe 62. As discussed above, this permits the intake to be connected to a source of dry gas and permits filtering of the intake through filter 151. The air intake is configured upwards and covered by a breather cap 152 to avoid rain water intake.

Figure 10:
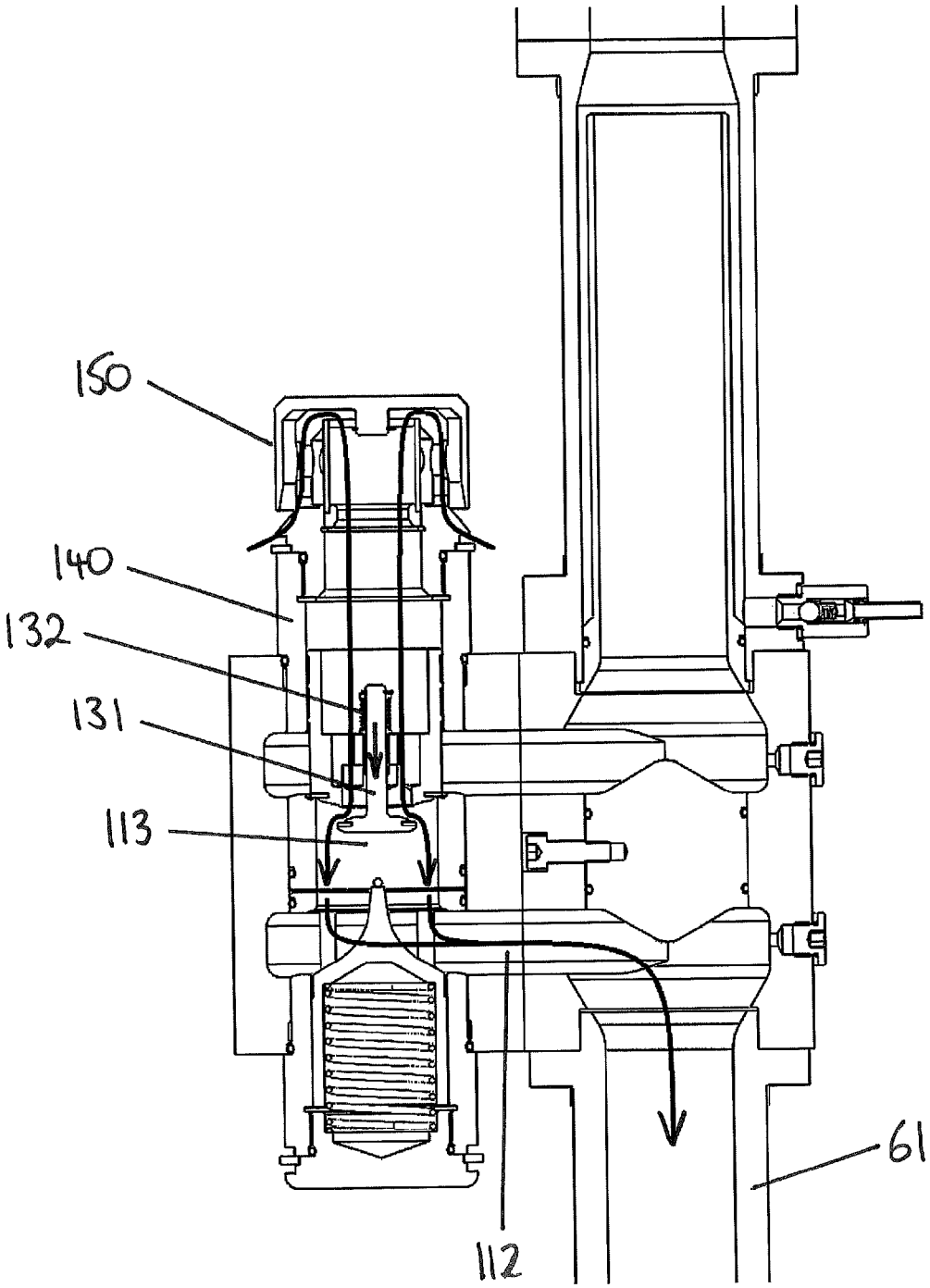
FIG. 10 shows a cross-sectional side view of the pressure vacuum valve module of FIG. 8, in which the pressure vacuum valve is under excess vacuum conditions.

FIG. 10 shows the operation of PVV 140 under excess vacuum conditions in more detail. Vacuum valve 131 is drawn down in the direction of the arrow to its open position by the vacuum against the biasing force provided by spring 132. This connects chamber 113 to atmosphere via air intake 150, and the flow of air is shown by the arrows which relieves the excess vacuum in storage tank 40. Once the excess vacuum has been relieved, vacuum valve 131 will be drawn up to its closed position under the action of biasing spring 132.

Figure 11:
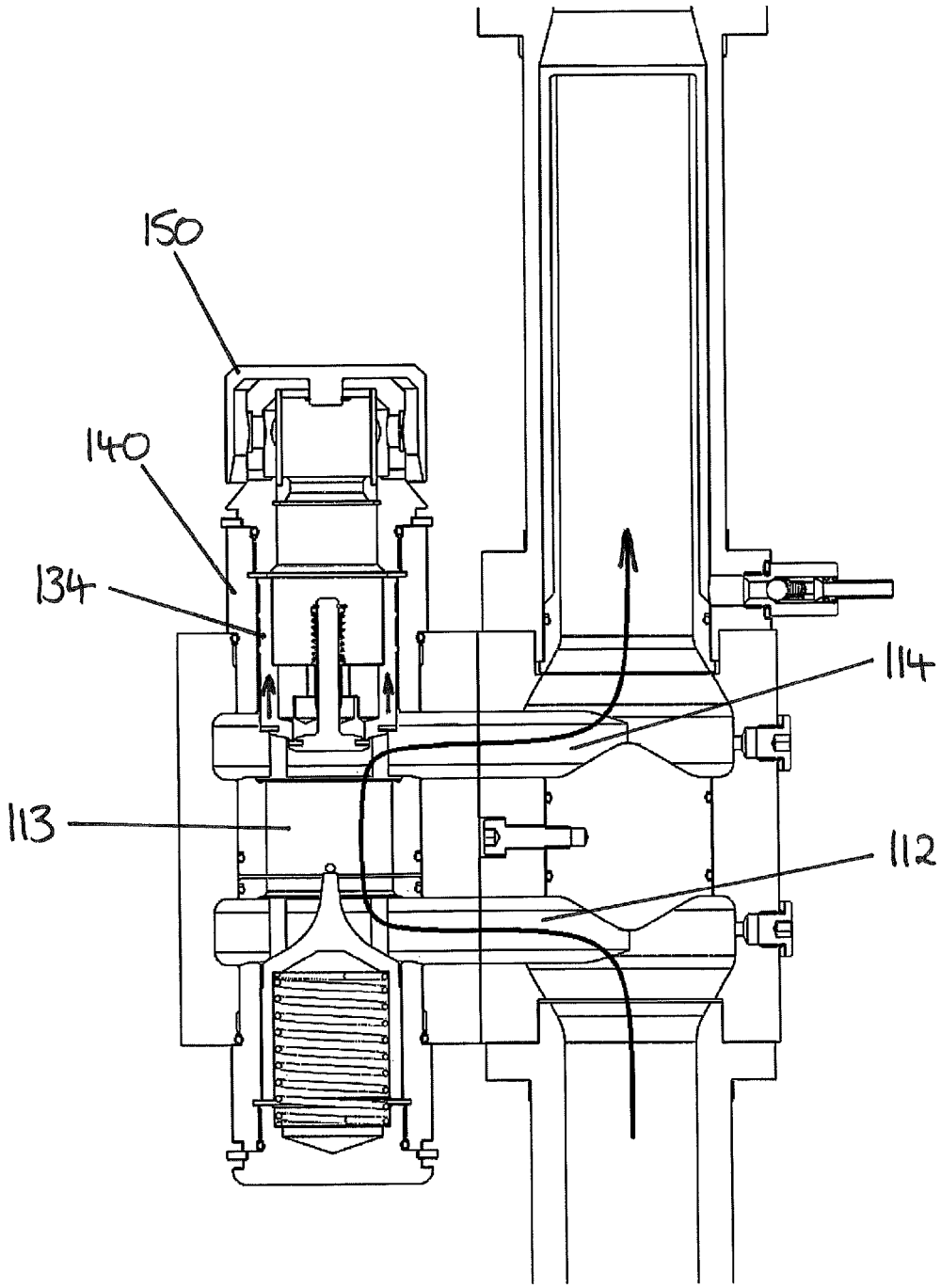
FIG. 11 shows a cross-sectional side view of the pressure vacuum valve module of FIG. 8, in which the pressure vacuum valve is under excess pressure conditions.

FIG. 11 shows the PVV 140 under excess pressure conditions, operating in the same way as PVV 130 shown in FIG. 4. The features and operation of the shut-off valve 120 in this embodiment are the same as described in relation to FIG. 5 and the features and operation of the condensate collector 200 in this embodiment are the same as described in relation to FIG. 6.

Figure 12:
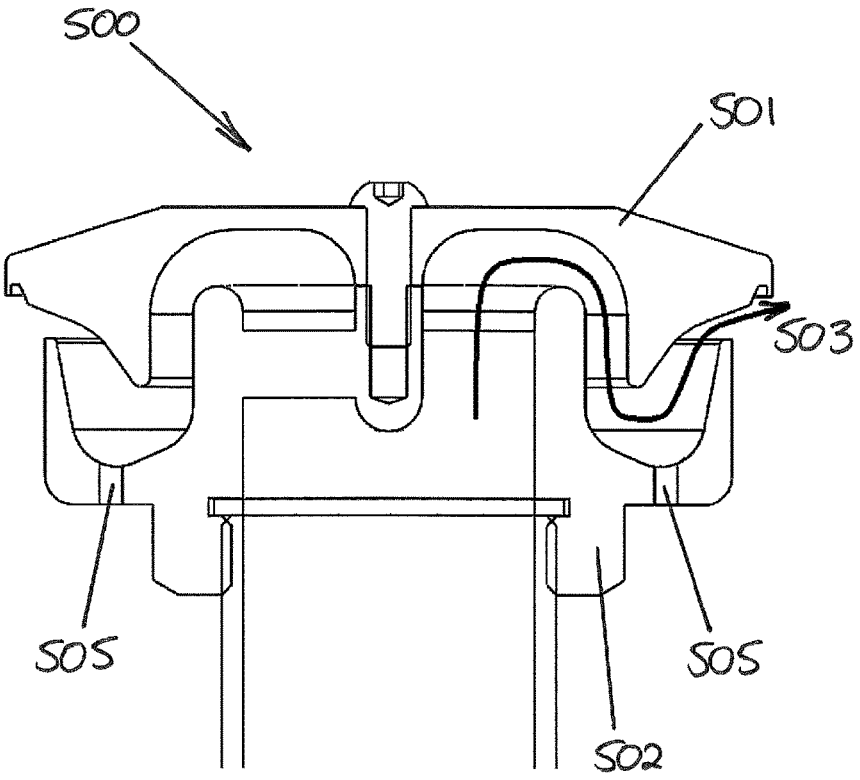
FIG. 12 shows a cross-sectional view of a rain cap suitable for diesel applications.

FIG. 12 shows a cross-sectional view of a rain cap 500 suitable for diesel applications. Rain cap 500 is mounted at the upper end of vent pipe 62 and is formed from upper body 501 and lower body 502. When the upper and lower bodies are fitted together, a serpentine vent path 503 through the rain cap is formed. In this diesel embodiment, a flame arrester gauze is not required. Drainage holes 505 are provided at appropriate intervals through lower body 502.

I claim:

1. A vent system for a fuel storage tank, the vent system defining a vent path from the fuel storage tank to atmosphere and comprising:

an elongate vent pipe which extends vertically, from a lower end thereof, to a rain cap located at the upper end of the vent pipe, and a pressure vacuum valve located in a pressure vacuum valve module in the vent path upstream of the lower end of the vent pipe and downstream of the tank, the vent path passing through the pressure vacuum valve module via the pressure vacuum valve, wherein the pressure vacuum valve maintains the vent path in a closed condition unless the pressure in the tank is above or below a predetermined pressure, and wherein the pressure vacuum valve module includes a shut-off valve which closes the vent path when the pressure vacuum valve is removed from the pressure vacuum valve module.

2. The vent system of claim 1, wherein the pressure vacuum valve is accessible from the ground by being located in the vent path at a height no greater than 1.8 meters above ground, or no greater than 1.5 meters above ground, or no greater than 1 meter above ground.

3. The vent system of claim 1, wherein the fuel storage tank is located underground.

4. The vent system of claim 1, wherein the vent path deviates from the axis of the vent pipe to the pressure vacuum valve which is located in a position offset from the vent pipe axis.

5. The vent system of claim 1, wherein the pressure vacuum valve is removable from the pressure vacuum valve module.

6. The vent system of claim 5, wherein the pressure vacuum valve is secured in the pressure vacuum valve module with tamper-proof fixings.

7. The vent system of claim 1, wherein the pressure vacuum valve holds the shut-off valve in the open position when located in the pressure vacuum valve module, against a biasing force, so that the shut-off valve closes the vent path automatically when the pressure vacuum valve is removed from the pressure vacuum valve module.

8. The vent system of claim 1, wherein the pressure vacuum valve comprises a pressure relief valve which opens the vent path when the pressure in the tank is higher than a predetermined value.

9. The vent system of claim 1, wherein the pressure vacuum valve comprises a vacuum relief valve which opens when the pressure in the tank is lower than a predetermined value.

10. The vent system of claim 9, wherein the vacuum relief valve opens the vent path when the pressure in the tank is lower than a predetermined value, allowing the excess vacuum in the tank to be relieved through the vent path.

11. The vent system of claim 9, wherein the pressure vacuum valve comprises an inlet in connection with the vacuum relief valve and wherein the vacuum relief valve opens the inlet when the pressure in the tank is lower than a predetermined value, allowing the excess vacuum in the tank to be relieved through the inlet and not through the vent path.

12. The vent system of claim 11, wherein the inlet is provided with a filter.

13. The vent system of claim 11, wherein the inlet is connected to a source of substantially dry gas.

14. The vent system of claim 1, wherein the vent path through the rain cap is serpentine.

15. The vent system of claim 14, wherein the rain cap is formed from upper and lower bodies which, when fitted together, form the serpentine vent path through the rain cap.

16. The vent system of claim 14, wherein a drainage aperture is provided in the serpentine path at the lowermost point of the path.

17. The vent system of claim 1, wherein the vent pipe comprises a condensate collector to collect condensate forming on the inside of vent pipe.

18. The vent system of claim 17, wherein the condensate collector comprises an annular condensate collection cavity formed between the inner wall of the vent pipe and the outer wall of a pipe of a smaller diameter mounted coaxially within the vent pipe.

19. The vent system of claim 18, wherein the condensate collector further comprises a discharge valve which opens to discharge the condensate when the condensate has reached a predetermined level in the collection cavity.

20. The vent system of claim 1, wherein one or more test apertures are provided in the vent path.

21. The vent system of claim 20, wherein a test aperture is provided on each side of the pressure vacuum valve.

* * * * *